United States Patent [19]

Isobe et al.

[11] 4,348,120

[45] Sep. 7, 1982

[54] PRINTING HEAD FOR A DOT PRINTER

[75] Inventors: Minoru Isobe; Hiroshi Kikuchi; Minoru Teshima, all of Tokyo; Tadasi Kodama, Sakura; Wataru Ohara, Yokosuka, all of Japan

[73] Assignees: Oki Electric Industry Co. Ltd.; Nippon Telegraph & Telephone Public Corporation, both of Tokyo, Japan

[21] Appl. No.: 147,106

[22] Filed: May 6, 1980

[30] Foreign Application Priority Data

May 11, 1979 [JP] Japan ..... 54-56924
May 11, 1979 [JP] Japan ..... 54-56925
May 22, 1979 [JP] Japan ..... 54-62143

[51] Int. Cl.[3] ..... B41J 3/12
[52] U.S. Cl. ..... 400/124; 101/93.05
[58] Field of Search ..... 400/124; 101/93.05

[56] References Cited

U.S. PATENT DOCUMENTS 3,770,092 11/1973 Grim ..... 101/93.05 X
3,876,050 4/1975 Linder ..... 101/93.05 X
3,896,918 7/1975 Schneider ..... 400/124
3,941,051 3/1976 Barrus et al. ..... 101/93.04
4,222,674 9/1980 Mori et al. ..... 400/124
4,225,250 9/1980 Wagner et al. ..... 101/93.05 X

*Primary Examiner*—Paul T. Sewell
*Attorney, Agent, or Firm*—Armstrong, Nikaido, Marmelstein & Kubovcik

[57] ABSTRACT

A printer head for mosaic printing having a plurality of needles positioned on a straight line each being selectively driven towards a paper through an ink ribbon has been found. The printer head comprises of a cylindrical permanent magnet, a first yoke covering the bottom of the permanent magnet, a plurality of electromagnets each positioned on a circle on the first yoke with the predetermined angle intervals, a disk shaped spring having an outer ring and a plurality of projections towards the center of the disk, a plurality of armatures each attached to the related projection of the disk spring, a plurality of print needles each attached to the related projection of the disk spring so that each of the needles has the perpendicular component to the disk spring plane. A ring shaped spacer is positioned between the disk spring and the cylindrical permanent magnet, a second yoke for providing a magnetic flux path is positioned between the permanent magnet and each of the electromagnets, and a guideframe having a thin linear slit for arranging the top of said needles and covering the needles is provided.

3 Claims, 10 Drawing Figures

PRINTING HEAD FOR A DOT PRINTER

BACKGROUND OF THE INVENTION

The present invention relates to a structure of a printer head for a dot printer, in particular, relates to such a printer head which is small in size and can operate with less power consumption.

FIG. 1 shows the principle of the dot matrix printing in a serial printer. A printer head 100 has seven needles for mosaic printing, and travels along a printing line in the direction of the arrow A. During the travelling, needles are selectively driven to hit a paper through an ink ribbon and a desired pattern "A", "B", "C" or "D" is printed. The selection of needles is controlled by the content of an integrated circuit (IC) memory. When the size of a character to be printed is 2.67 mm×2.05 mm, 7×5 number of dots are enough for printing a recognizable character.

The prior needle dot head for dot printing process is shown in the U.S. Pat. No. 3,896,918, in which an electromagnetic drive for the operation of printing needles of a mosaic printing head includes a pivotally mounted armature for each needle which are arranged along circular arc. The construction includes a common yoke for all of the electromagnets which comprises two concentric cups or walls forming a single unit with cylindrical cores arranged at equal intervals along a circular arc parallel to the genatrix of the cup and located between the individual yoke cups.

However, said prior printing head has the disadvantages that the power consumption for driving needles is large, the size of the apparatus is large, and the operational speed of the printer is rather slow. Those disadvantages come mainly from the fact that a needle is drived by an electromagnet, and all the printing power for striking a paper by a needle is provided by said electromagnet.

SUMMARY OF THE INVENTION

It is an object, therefore, of the present invention to overcome the disadvantages and limitations of a prior printer head by providing a new and improved printer head.

It is also an object of the present invention to provide a printer head which is small in size and can operate with small power consumption.

The above and other objects are attained by a printer head for a dot printer comprising of a cylindrical permanent magnet, and a first yoke covering the bottom of said magnet, a plurality of electromagnets positioned on a circle on said first yoke with the predetermined angle intervals. A disk shaped spring is provided having an outer ring and a plurality of projections towards the center of the disk and a plurality of armatures are each attached to the related projection of said disk spring. A plurality of print needles are each attached to the related projection of the disk spring so that each of said needles has the perpendicular component to the disk spring plane, a ring shaped spacer is positioned between the disk spring and said cylindrical permanent magnet, a second yoke for provides a magnetic flux path between the permanent magnet and each of said electromagnets, and a guideframe having a thin linear slit is provided for arranging the top of said needles and said guideframe covering the print needles.

BRIEF DESCRIPTION OF THE DRAWINGS

The foregoing and other objects, features, and attendant advantages of the present invention will be highly understood as the same become better understood by means of the following description and accompanying drawings wherein.

DESCRIPTION OF THE PREFERRED EMBODIMENTS

Figure 2:
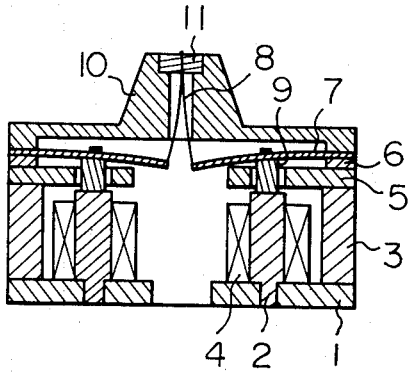
FIG. 2 is the cross sectional view of the printer head according to the present invention.
Figure 3:
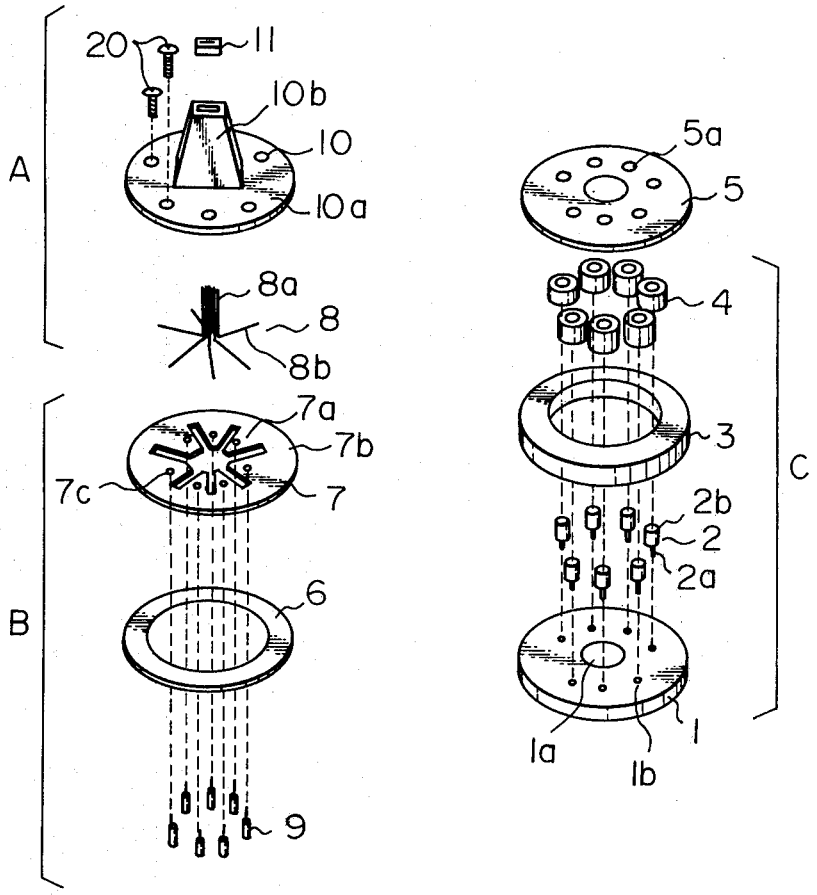
FIG. 3 is the disassembled view of the components of the printer head according to the present invention.

FIG. 2 shows the cross sectional view of the printer head according to the present invention, and FIG. 3 is the disassembled parts of the printer head of FIG. 2. In those figures, the reference numeral 1 is a disk shaped first yoke made of ferromagnetic material having a center hole 1*a* and seven small pin holes 1*b*, distributed with a predetermined angle interval on a circle. The reference numeral 2 is a column core made preferably of silicon steel which operates as a magnetic core of an electromagnet. The column core 2 has a thin projection 2*a* and the main body 2*b*, and the body 2*b* is positioned on the small hole 1*b* of the first yoke 1 by said projection 2*a*. The reference numeral 3 is a cylindrical permanent magnet magnetized in the axial direction, and is made preferably of a ferrite. The reference numeral 4 is a coil wound on said column core 2, 5 is a second yoke having a hole 5*a* which is positioned along a circle with the predetermined angle interval, and 6 is a spacer made of non-magnetic material or magnetic material. The reference numeral 7 is a disk shaped spring made preferably of carbon steel, and has common outer ring 7*b* and seven projections 7*a* which project from the common ring 7*b* towards the center of the disk. Each projection 7*a* has a small pin hole 7*c*. Therefore, it should be appreciated that each projection 7*a* can be individually biased from the common ring 7*b*. The reference numeral 8 is a L-shaped print needle having the first arm 8*a* and the second arm 8*b* and said needle is connected to the edge of the projection 7*a* of the disk spring by welding. The reference numeral 9 is an armature pin which is fixed to the projection 7*a* of the disk spring 7 by being positioned by the small hole 7*c*, and the armature pin 9 can be attracted by the electromagnet 2 through the hole 5*a* of the second yoke 5. The reference numeral 10 is a guideframe having a disk 10*a* and a hollow guide 10*b*, and the reference numeral 11 is a pinguide which is mounted at the top of the hollow guide 10*b* for guiding the top of the print wires or needles 8.

In the above structure, the disk shaped spring having a ring 7*b* and a plurality of projections 7*a* is one of the features of the present invention.

In assembling the above components, the half-assemblies A, B and C are first prepared. The first half-assembly A is the combination of the guideframe 10 and the pinguide 11, which is mounted at the top of the hollow guide 10*b* of the guideframe 10 by adhesive means. The half-assembly A is called a guideframe assembly.

Figure 5:
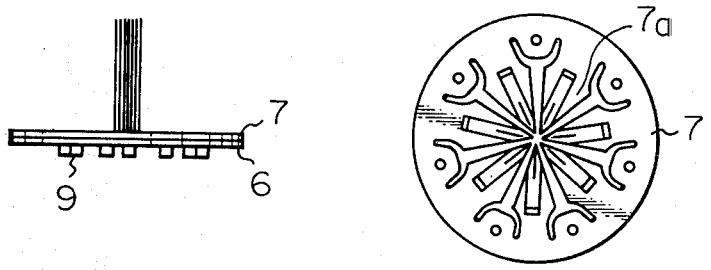
FIG. 5 shows the needle assembly of the printer head according to the present invention.

The half assembly B which is called a needle assembly has a disk spring 7, a plurality of needles 8 attached to the projections of the spring 7 and a plurality of armatures 9 attached to the projections of the spring 7. Preferably, the spacer 6 is also attached on the spring 7 by welding. The assembled needle assembly is shown in FIG. 5.

Figure 4:
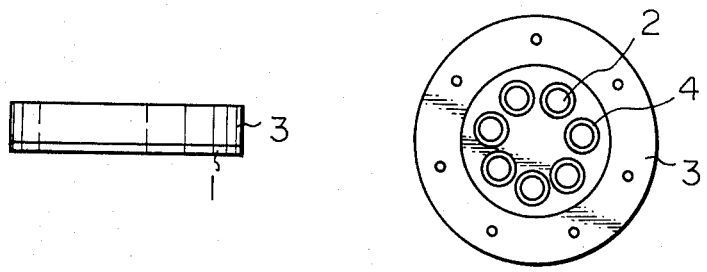
FIG. 4 shows the structure of the magnet assembly of the printer head according to the present invention.

The half assembly C which is called a magnet assembly has the first yoke 1, a plurality of cores 2 mounted on the yoke 1 with a predetermined angle interval, a plurality of coils 4 each wound on the related core, and a permanent magnet 3 which is fixed to the first yoke 1 by adhesive means. Preferably the second yoke 5 may be fixed on the magnet 3 by adhesive means. The assembled magnet assembly is shown in FIG. 4.

The guideframe assembly A, the needle assembly B, the magnet assembly C, together with the second yoke 5 and the spacer 6 are assembled together by a plurality of screws 20. Each screw 20 goes through the hole on the guideframe 10, the disk spring 7, the spacer 6, the second yoke 5, the magnet 3 and is fixed to the first yoke 1. The hole in the members 7, 6, 5, 3 and 1 for screws 20 is not shown for the sake of the simplicity of the drawing. The lead lines (not shown) of the coils 4 are connected to an external circuit through the center hole 1*a* of the first yoke 1.

Figure 6:
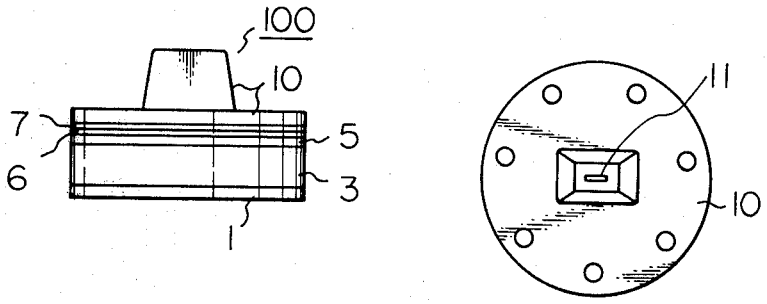
FIG. 6 shows the external appearance of the printer head according to the present invention.

The assembled printer head is shown in FIG. 6.

Figure 1:
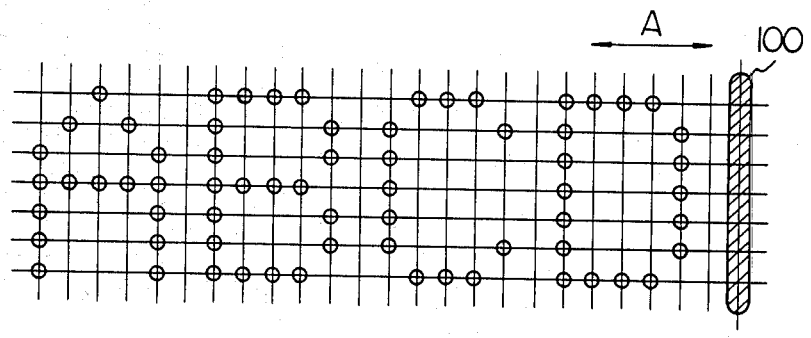
FIG. 1 shows a mosaic pattern for the explanation of the dot matrix printing of the present invention.

The operation of the printer head of FIGS. 1 and 2 is now described.

When the coil 4 is not energized, the magnetic flux induced by the cylindrical permanent magnet 3 circulates from the magnet 3 through the second yoke 5, the armature 9, the column core 2, the first yoke 1 to the magnet 3. Therefore, the armature 9 together with the projection 7*a* of the spring 7, are attracted to the column core 2 by the force of the permanent magnet 3. Each of the armatures 9 and the projections 7*a* are attracted by the related column core independently, and when the armatures are attracted by the core, the tops of the L-shaped print needles are aligned on a straight line, and are secured in the guideframe 10. Therefore, when the coil 4 is not energized, the disk spring 7 is biased or energized by the permanent magnet.

Next, when one of the coils 4 is energized by flowing the electric current in said coil 4, the related column core 2 is magnetized, so that the magnetic flux generated by the coil 4 cancels the magnetic flux of the permanent magnet 3. Therefore, the related armature 9 is not attracted by the column core 2 anymore, but is released. When the projection 7*a* of the spring 7 is released, the needle 8 attached at the top of the projection 7*a* of the spring 7 is strongly forced to go out, of the guideframe 10, and the needle thus pushed strikes a paper through an ink ribbon, then a dot is printed on a paper. Therefore, a needle is driven by the energy stored in the spring in the present invention, while a needle of the prior art is driven by the force of an electromagnet.

Next, when the electric current in the coil 4 stops, the magnetic flux generated by the coil 4 is also stopped and the magnetic flux generated by the permanent magnet 3 is not canceled in the related column core 2, and thus, the armature 9 is attracted again to the column core 2. When the armature 2 is attracted to the column core 2, the armature 2 does not vibrate and no chattering occurs.

Figure 7:
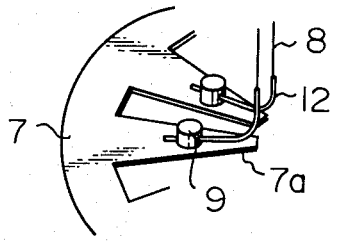
FIG. 7 shows the modification of the needle assembly.
Figure 8:
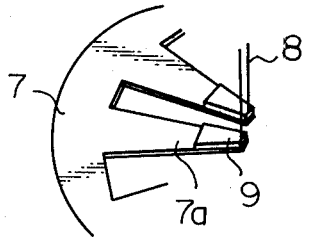
FIG. 8 is another modification of the needle assembly.

Now, some modifications are described in accordance with FIG. 7 and FIG. 8.

FIG. 7 is the embodiment for attaching a print needle 8 to a disk spring 7. In FIG. 7, the top of an armature 9 passes through the projection 7*a* of the spring 7. The top of an armature 9 has a small hole therein. A hollow thin pipe 12 is positioned through the hole in armature 9, and a print needle 8 is inserted through the pipe 12. Both the print needle 8 and the pipe 12 are bent in a L-shape as shown in the drawing. The stress applied to the bent portion of a print needle 8 is thereby reduced. Further, the movement of an armature can be transferred to a print needle directly without transferring that movement through the disk spring, and thus, the operation of a print needle can be stabilized. Further, since a print needle 8 is not welded, the change of the characteristics of the material of the print needle resulting from the high temperature in a welding operation does not occur.

FIG. 8 is another embodiment for attaching a print needle 8 to a disk spring 7. In FIG. 8, the top of an armature 9 is positioned above the projection of the disk spring 7, and a print needle 8 is welded to that top of an armature. In this case, a print needle 8 is not in L-shaped, but is linear. The print needle 8 is thus directly attached to an armature 9 and therefore the movement of an armature is directly transferred to a print needle. Further, since the print needle is linear and has no bends, the print needle can be strong and is not broken.

Figure 9:
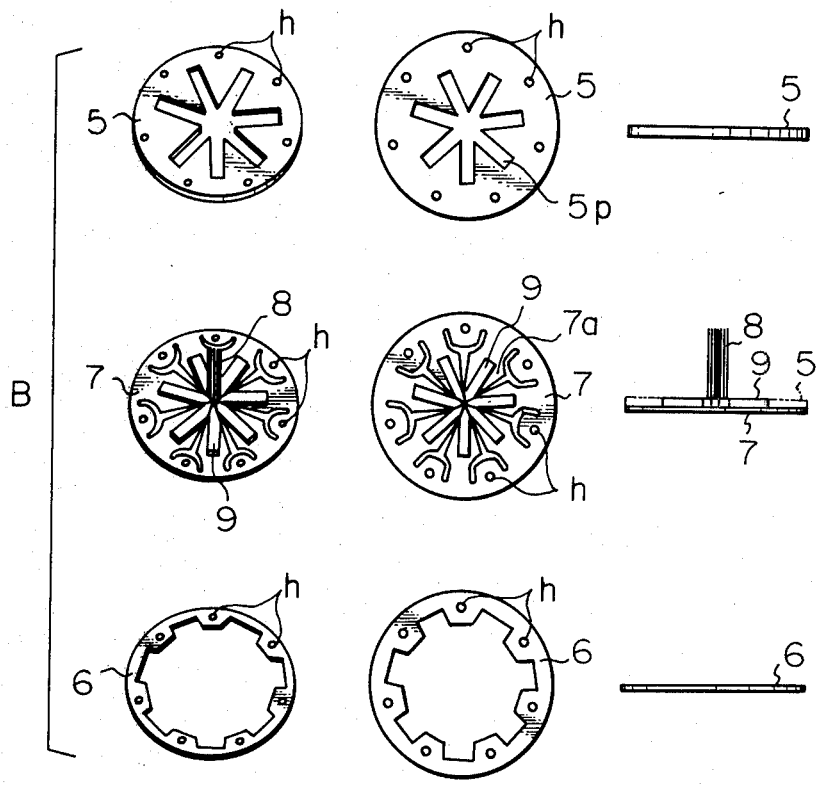
FIG. 9 is still another modification of the needle assembly.

FIG. 9 is the modification of a needle assembly. In this case, an armature 9 is welded on the projection 7*a* of the disk spring 7, and at the edge of an armature 9, a linear needle 8 is welded. A spacer 6 is also welded under the disk spring 7. The second yoke 5 is positioned above the disk spring 7. The second yoke 5 has a radial slit 5*p* which has seven arms, and the armatures 9 are positioned in the slits 5*p*. Therefore, when assembled, armatures 9 are buried in the second yoke 5. Preferably, the thickness or the height of an armature 9 is the same as that of the second yoke 5. In FIG. 9, the left column shows the disassembled components, the center column shows the plane view of perspective view of the each component, and the right column shows the vertical view of each component. The holes (h) provided at the peripheral portions of those components receive screws (20 in FIG. 3) for fixing the assembly.

Figure 10:
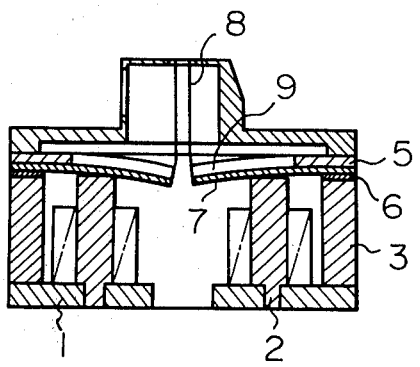
FIG. 10 is the cross sectional view of the printer head of the modification of FIG. 9.

FIG. 10 is the cross sectional view of the printer head with regard to the embodiment of FIG. 9. It should be noted in FIG. 10 that the second yoke 5 is above the disk spring 7, while the second yoke 5 in FIG. 2 is below the disk spring 7.

Finally, the numerical embodiment of the present printer head is described.

When the size of a character to be printed is 2.65 mm×2.05 mm, the number of print needles 8 is seven, and thus, the number of projections and the electromagnets is also seven. The diameter of a print needle 8 is 0.36 mm, and that needle is made of a hard steel including tungsten and cobalt. The permanent magnet 3 has a 35 mm the outer diameter, a 22 mm inner diameter, and an 8 mm height, and the magnet is made of ferrite material. The column core 2 of an electromagnet has a 3.5 mm diameter and is made of silicon steel. The coil 4, wound on the column core 2, is an enameled wire of 0.1 mm, and has 490 turns. The electric current applied to the coil is 1 ampere. The disk spring 7 is made of carbon steel for a spring material. The length of the stroke of the print needles is 0.6 mm at the top of the needle, and is 0.4 mm at the portion of the projection of the disk spring.

According to the structure of the present printer head, the present invention has the advantages that the size of the apparatus is small, the power consumption in the coil 4 is small, and the printing speed is high. A printing speed up to 120 characters every second is possible. Further, since the strike action or the movement of a print needle is actuated by a disk spring, the pressure by a needle is always constant irrespective to the change of the electric current applied to a coil, thus, the excellent print quality is obtained.

Further, it should be appreciated that the present printer head is suitable for use in a keyboard printer, which has a manual keyboard for the input of characters, since the present printer head is utilized in a serial printer.

From the foregoing it will now be apparent that a new and improved printer head has been found. It should be understood of course that the embodiments disclosed are merely illustrative and are not intended to limit the scope of the invention. Reference should be made to the appended claims, therefore, rather than the specification as indicating the scope of the invention.

What is claimed is:

1. A printer head comprising:

a cylindrical permanent magnet, a first yoke covering the bottom of said magnet, n number of electromagnets (n is an integer) each having a center core and a coil wound around the core, positioned in a circle on said first yoke with predetermined angle intervals therebetween, a disk shaped spring having an outer ring and n number of projections projecting towards the center of said outer ring, n number of elongated armatures each having first portion of predetermined shape and a tapered end portion wherein each of said armatures is positioned on one of the projections of said disk spring, n number of print needles each fixed to one of said armatures perpendicular to the plane of the disk spring wherein each of said needles is straight, a ring shaped spacer positioned between said disk spring and said cylindrical permanent magnet, a second circular yoke fixed on said disk spring for providing a magnetic flux path between the permanent magnet and each of said electromagnets, said second circular yoke having radial slits having a shape corresponding to said predetermined shape for receiving said armatures wherein the tapered end portions of said armatures extend from said slits at the center of said yoke and wherein the thickness of the radial slits is equal to the thickness of said armatures, and a guideframe having a thin linear slit for receiving the tops of said print needles wherein said guideframe covers the print needles.

2. A printer head according to claim 1, wherein said number (n) is seven.

3. A printer head according to claim 1, wherein said print needle is made of a hard steel containing tungsten and cobalt.

* * * * *